US011842877B2

(12) United States Patent
Masmeier et al.

(10) Patent No.: US 11,842,877 B2
(45) Date of Patent: Dec. 12, 2023

(54) ELECTRIC POLE PART APPARATUS

(71) Applicant: ABB Schweiz AG, Baden (CH)

(72) Inventors: Philipp Masmeier, Düsseldorf (DE); Michael Weuffel, Bergheim (DE); Patrick Rumpelt, Duisburg (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/584,621

(22) Filed: Jan. 26, 2022

(65) Prior Publication Data

US 2022/0238285 A1 Jul. 28, 2022

(30) Foreign Application Priority Data

Jan. 27, 2021 (EP) ..... 21153684

(51) Int. Cl.
*H01H 9/52* (2006.01)

(52) U.S. Cl.
CPC ..... *H01H 9/52* (2013.01); *H01H 2009/523* (2013.01)

(58) Field of Classification Search
CPC ..... H01H 9/52; H01H 2009/523; H01H 2009/526; H01H 33/66; H01H 2033/6613
USPC ..... 200/237, 289
See application file for complete search history.

(56) References Cited

U.S. PATENT DOCUMENTS 4,005,297 A * 1/1977 Cleaveland ..... H01H 1/62 174/15.2
4,123,618 A * 10/1978 Cushing ..... H01H 33/68 174/209
7,038,912 B2 * 5/2006 Pleines ..... F28F 3/048 218/155
7,471,495 B2 * 12/2008 Steffens ..... H01H 1/62 361/115
7,557,295 B2 * 7/2009 Kiefer ..... H02G 5/10 174/15.1
8,717,745 B2 * 5/2014 Frigiere ..... H01H 9/52 361/689
9,867,316 B2 * 1/2018 Kaufmann ..... H05K 7/20318
2009/0255794 A1 * 10/2009 Kurth ..... H01H 33/6606 200/289

(Continued)

FOREIGN PATENT DOCUMENTS

DE 102015213608 A1 1/2017
EP 2677611 A1 12/2013
EP 2720244 A1 4/2014

(Continued)

OTHER PUBLICATIONS

Translation of DE102015213608 (Original document published Jan. 26, 2017) (Year: 2017).*

(Continued)

*Primary Examiner* — William A Bolton
(74) *Attorney, Agent, or Firm* — Leydig, Voit & Mayer, Ltd.

(57) ABSTRACT

A system and method for an electric pole part apparatus, includes an electric interruption unit; a heat sink; and a heat pipe arrangement; wherein the heat pipe arrangement comprises a plurality of heat pipes enclosed at least partially by an outer housing; wherein a first end of the heat pipe arrangement is connected to the heat sink; and wherein a second end of the heat pipe arrangement is connected to the electric interruption unit.

13 Claims, 5 Drawing Sheets

(56) References Cited

U.S. PATENT DOCUMENTS

| | | | | |
|---|---|---|---|---|
| 2013/0319024 | A1* | 12/2013 | Fischer-Carne | H01H 9/52 62/119 |
| 2020/0263934 | A1* | 8/2020 | Iwamoto | H01H 9/52 |

FOREIGN PATENT DOCUMENTS

| | | | |
|---|---|---|---|
| EP | 2677611 | B1 | 2/2015 |
| EP | 2256767 | B1 | 8/2016 |
| EP | 3109880 | A1 | 12/2016 |
| WO | 2006/092380 | A1 | 9/2006 |
| WO | 2009/074016 | A1 | 6/2009 |
| WO | 2013/181027 | A1 | 12/2013 |
| WO | WO 2014/200662 | A1 | 12/2014 |

OTHER PUBLICATIONS

Indian Patent Office, Examination Report in Indian Patent Application No. 202144057958, 5 pp. (dated Aug. 2, 2022).

European Patent Office, Extended European Search Report in European Patent Application No. 21153684.2, 8 pp. (dated Jul. 12, 2021).

* cited by examiner

ELECTRIC POLE PART APPARATUS

CROSS-REFERENCE TO RELATED APPLICATIONS

This patent application claims priority to European patent application no. EP21153684, filed on Jan. 27, 2021, which is incorporated herein in its entirety by reference.

FIELD OF THE DISCLOSURE

The present invention relates to an electric pole part apparatus, and a method of manufacturing an electric pole part apparatus.

BACKGROUND OF THE INVENTION

Vacuum Circuit Breakers with a high nominal current show a behavior of heat dissipation, which naturally increases with higher currents quadratically. Thus Pole Housings for high currents request cooling devices to prevent themselves from overheating in operation.

It is state of the art to design Pole Housings in a way that parts of the current path offer blank surfaces where heatsinks can be applied and so heat is conducted to cooling fins and radiators. Normally the dimensioning of these devices is limited by size as the (metal) parts remain on high voltage potential.

By transporting the power via different parts of the Vacuum interrupter, the pole housings current path parts and via different surface from one part to another, several thermal resistances are created, which cause a temperature difference between the source of heat (mainly inside the pole housing) and the radiator outside. A low temperature difference is more advantageous because a higher temperature at the radiator allows a much higher heat radiation (proportional to the fourth power of temperature.

While the implementation of Heat pipes in medium voltage circuit breaker (MVCB) Pole Housings is a known state of the art, the advantages of Heat pipes have not been fully realized. To clearly avoid thermal resistances, it is necessary to find proper means of assembling them into a given structure. Such a structure is for example a vacuum interrupter, which is assembled in a highly sensitive process to achieve ultra-high vacuum, clean surfaces and sealed interfaces, and where standard heat pipes cannot be utilized.

There is a need to address this problem.

BRIEF SUMMARY OF THE INVENTION

Therefore, it would be advantageous to have an improved technique to cool an electric pole part, such as a vacuum interrupter, of a system such as medium voltage switchgear or controlgear.

The object of the present invention is solved with the subject matter of the independent claims, wherein further embodiments are incorporated in the dependent claims.

In a first aspect, there is provided an electric pole part apparatus, comprising:

an electric interruption unit;

a heat sink; and a heat pipe arrangement.

The heat pipe arrangement comprises a plurality of heat pipes enclosed at least partially by an outer housing. A first end of the heat pipe arrangement is connected to the heat sink. A second end of the heat pipe arrangement is connected to the electric interruption unit.

In an example, the plurality of heat pipes are embedded within a thermal conductive material within the outer housing.

In an example, the thermal conductive material comprises a matrix of soldering material.

In an example, the second end of the heat pipe arrangement is inserted into a borehole within the electric interruption unit.

In an example, prior to insertion of the second end of the heat pipe arrangement into the borehole, a diameter of the outer housing of the heat pipe arrangement at a nominal temperature is greater than an inner diameter of the borehole.

In an example, insertion of the second part of the heat pipe arrangement into the borehole comprises a heating of at least a part of the electric interruption unit in the vicinity of the borehole.

In an example, insertion of the second part of the heat pipe arrangement into the borehole comprises a cooling of the second end of the heat pipe arrangement.

In an example, the connection of the second end of the heat pipe arrangement to the electric interruption unit comprises a solder connection between the second end of the heat pipe arrangement and the electric interruption unit.

In an example, the outer housing of the heat pipe arrangement comprises a heat conducting cylindrical housing.

In an example, the apparatus comprises a connection terminal. The connection terminal is located between the electric interruption unit and the heat sink, and the heat pipe arrangement extends through a bore through the connection terminal.

In an example, an outer surface of the outer housing of the heat pipe arrangement is spaced from an inner surface of the bore through the connection terminal.

In a second aspect, there is provided a method of manufacturing an electric pole part apparatus. The electric pole part apparatus comprises an electric interruption unit, a heat sink, and a heat pipe arrangement. The heat pipe arrangement comprises a plurality of heat pipes enclosed at least partially by an outer housing. The method comprises:

a) connecting a first end of the heat pipe arrangement to the heat sink; and b) connecting a second end of the heat pipe arrangement to the electric interruption unit.

In an example, step b) comprises inserting the second end of the heat pipe arrangement into a borehole within the electric interruption unit.

In an example, prior to insertion of the second end of the heat pipe arrangement into the borehole, a diameter of the outer housing of the heat pipe arrangement at a nominal temperature is greater than an inner diameter of the borehole, and wherein step b) comprises heating at least a part of the electric interruption unit in the vicinity of the borehole; and/or wherein step b) comprises cooling the second end of the heat pipe arrangement.

In an example, step b) comprises providing a solder connection between the second end of the heat pipe arrangement and the electric interruption unit.

The above aspects and examples will become apparent from and be elucidated with reference to the embodiments described hereinafter.

BRIEF DESCRIPTION OF THE SEVERAL VIEWS OF THE DRAWING(S)

Exemplary embodiments will be described in the following with reference to the following drawings.

DETAILED DESCRIPTION OF THE INVENTION

Figure 2:
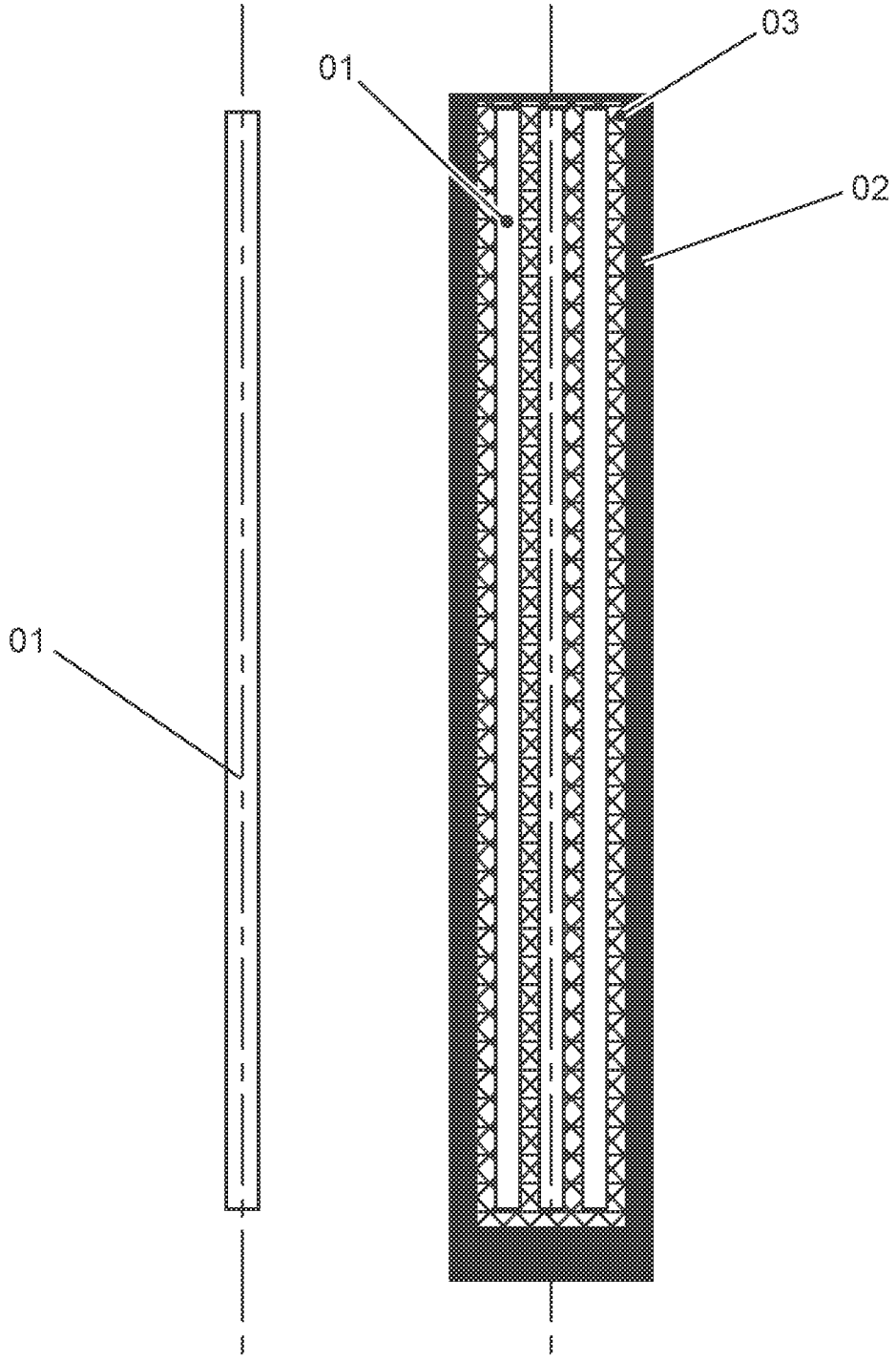
FIG. 2 shows a schematic arrangement of a heat pipe arrangement.
Figure 3:
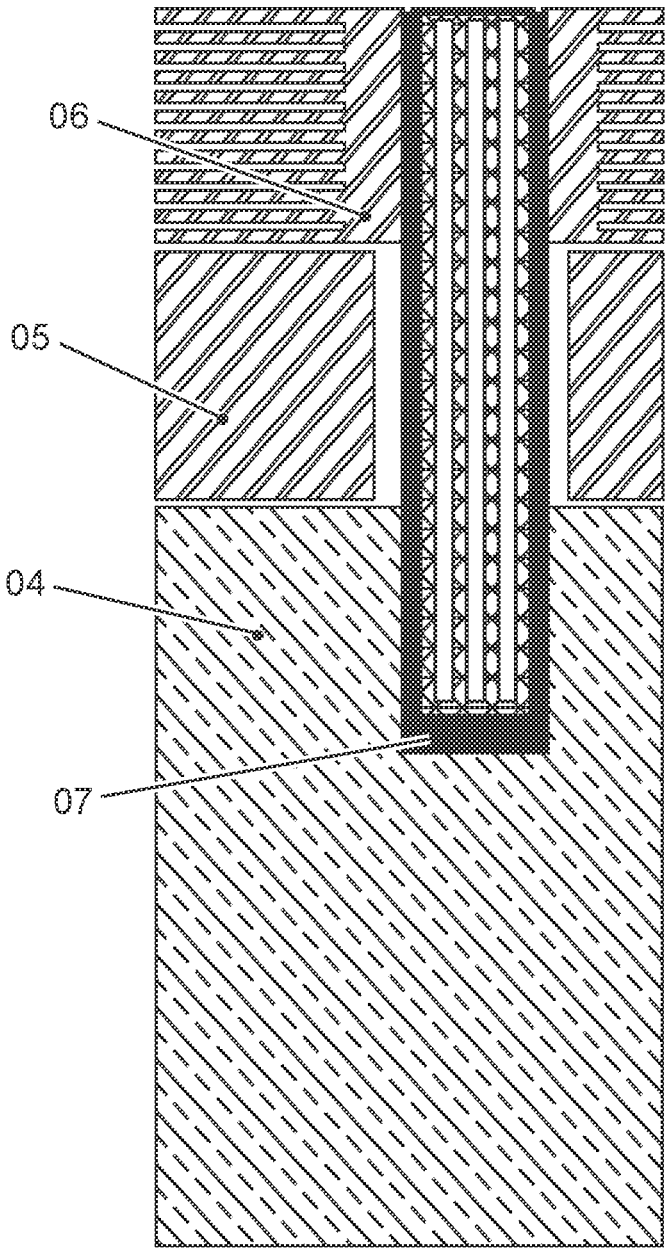
FIG. 3 shows a schematic representation of an electric pole part apparatus.
Figure 5:
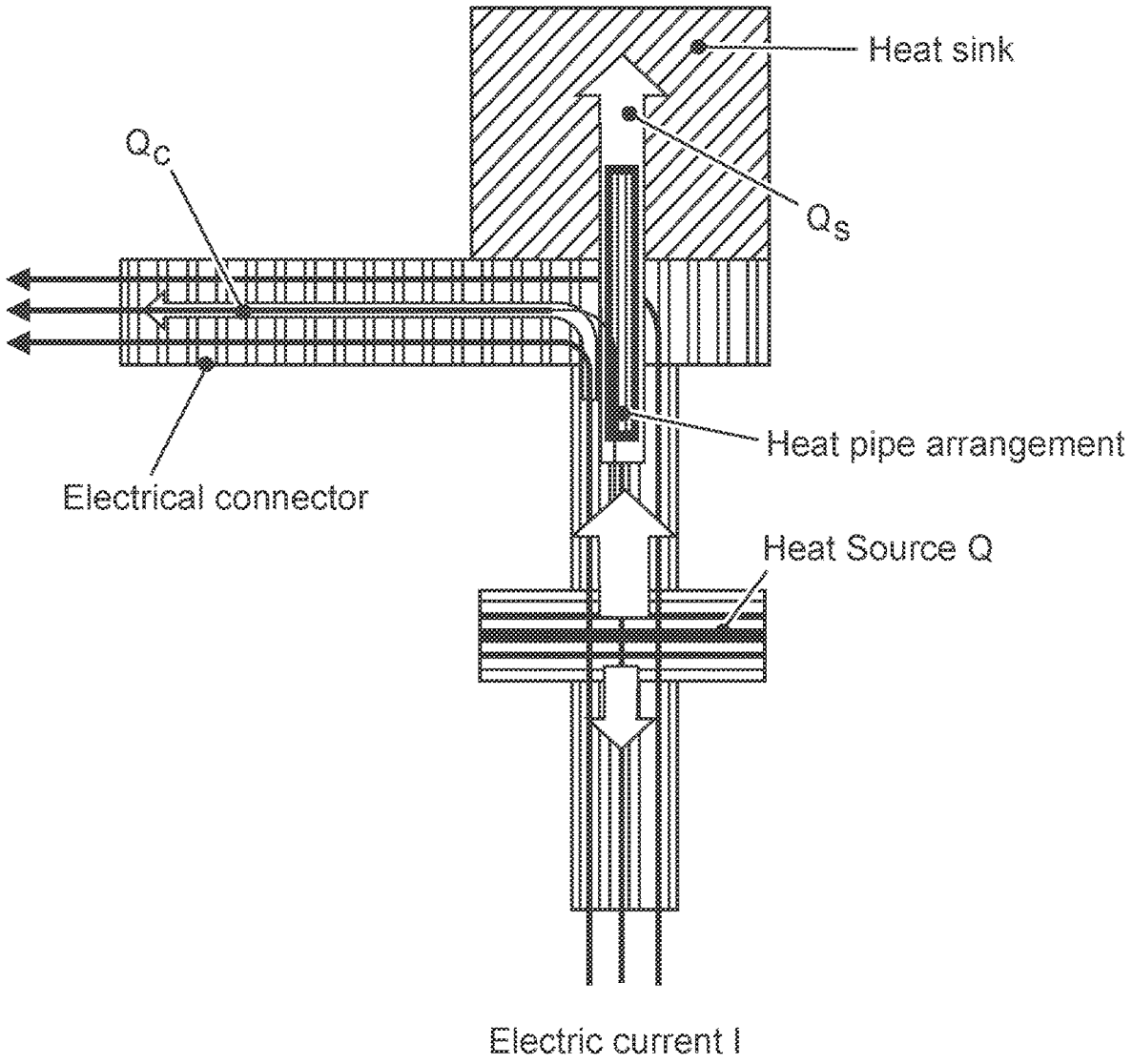
FIG. 5 shows a schematic representation of an electric pole part apparatus.

FIGS. 2, 3 and 5 relate to a new electric pole part apparatus. In an example, the electric pole part apparatus comprises an electric interruption unit 04, a heat sink 06, and a heat pipe arrangement 07. The heat pipe arrangement comprises a plurality of heat pipes 01 enclosed at least partially by an outer housing 02. A first end of the heat pipe arrangement is connected to the heat sink. A second end of the heat pipe arrangement is connected to the electric interruption unit.

According to an example, the plurality of heat pipes are embedded within a thermal conductive material within the outer housing.

According to an example, the thermal conductive material comprises a matrix of soldering material 03.

According to an example, the second end of the heat pipe arrangement is inserted into a borehole within the electric interruption unit.

According to an example, prior to insertion of the second end of the heat pipe arrangement into the borehole, a diameter of the outer housing of the heat pipe arrangement at a nominal temperature is greater than an inner diameter of the borehole.

According to an example, insertion of the second part of the heat pipe arrangement into the borehole comprises a heating of at least a part of the electric interruption unit in the vicinity of the borehole.

According to an example, insertion of the second part of the heat pipe arrangement into the borehole comprises a cooling of the second end of the heat pipe arrangement.

According to an example, the connection of the second end of the heat pipe arrangement to the electric interruption unit comprises a solder connection between the second end of the heat pipe arrangement and the electric interruption unit.

According to an example, the outer housing of the heat pipe arrangement comprises a heat conducting cylindrical housing.

According to an example, the apparatus comprises a connection terminal 05. The connection terminal is located between the electric interruption unit and the heat sink, and the heat pipe arrangement extends through a bore through the connection terminal.

According to an example, an outer surface of the outer housing of the heat pipe arrangement is spaced from an inner surface of the bore through the connection terminal.

From the above, it is also clear that a new method can be used to of manufacture an electric pole part apparatus. The electric pole part apparatus comprises an electric interruption unit 04, a heat sink 06, and a heat pipe arrangement 07. The heat pipe arrangement comprises a plurality of heat pipes 01 enclosed at least partially by an outer housing 02. The new method comprises the following steps:

a) connecting a first end of the heat pipe arrangement to the heat sink; and b) connecting a second end of the heat pipe arrangement to the electric interruption unit.

In an example, the plurality of heat pipes are embedded within a thermal conductive material within the outer housing.

In an example, the thermal conductive material comprises a matrix of soldering material 03.

According to an example, step b) comprises inserting the second end of the heat pipe arrangement into a borehole within the electric interruption unit.

According to an example, prior to insertion of the second end of the heat pipe arrangement into the borehole, a diameter of the outer housing of the heat pipe arrangement at a nominal temperature is greater than an inner diameter of the borehole, and wherein step b) comprises heating at least a part of the electric interruption unit in the vicinity of the borehole; and/or wherein step b) comprises cooling the second end of the heat pipe arrangement.

According to an example, step b) comprises providing a solder connection between the second end of the heat pipe arrangement and the electric interruption unit.

In an example, the outer housing of the heat pipe arrangement comprises a heat conducting cylindrical housing.

In an example, the apparatus comprises a connection terminal (05), wherein the connection terminal is located between the electric interruption unit and the heat sink, and wherein the heat pipe arrangement extends through a bore through the connection terminal.

In an example, an outer surface of the outer housing of the heat pipe arrangement is spaced from an inner surface of the bore through the connection terminal.

Figure 1:
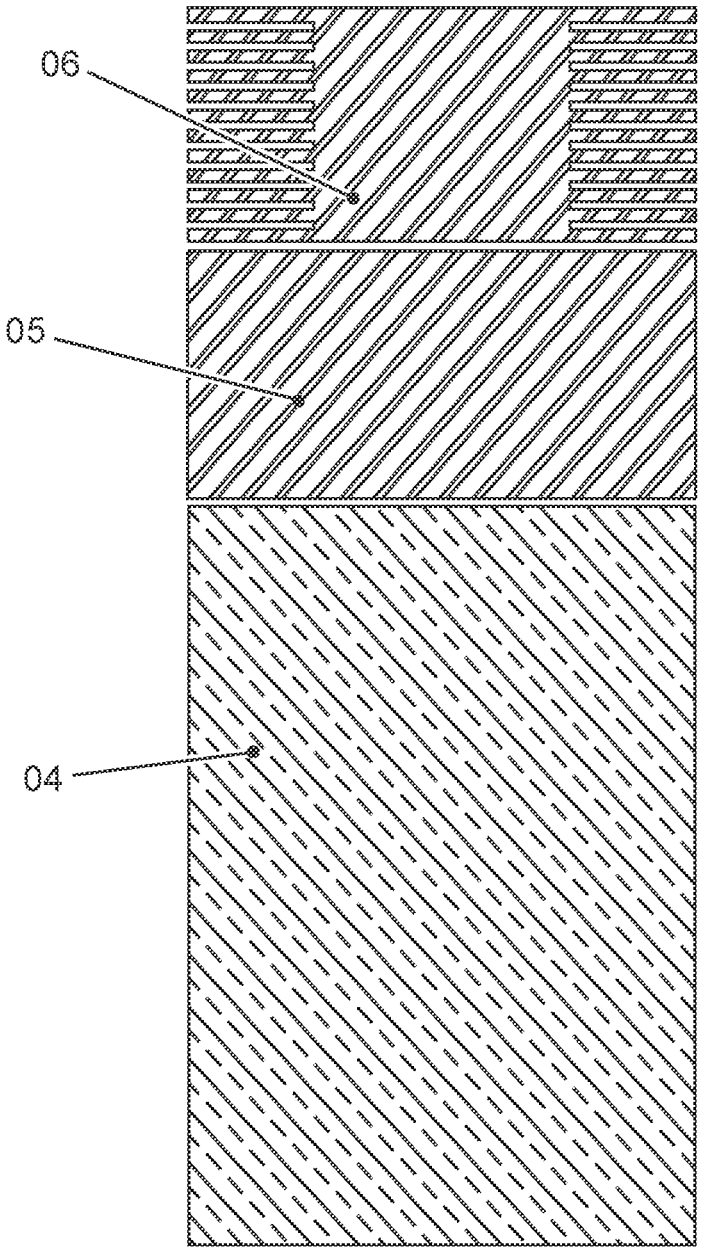
FIG. 1 shows a schematic representation of a pole housing.
Figure 4:
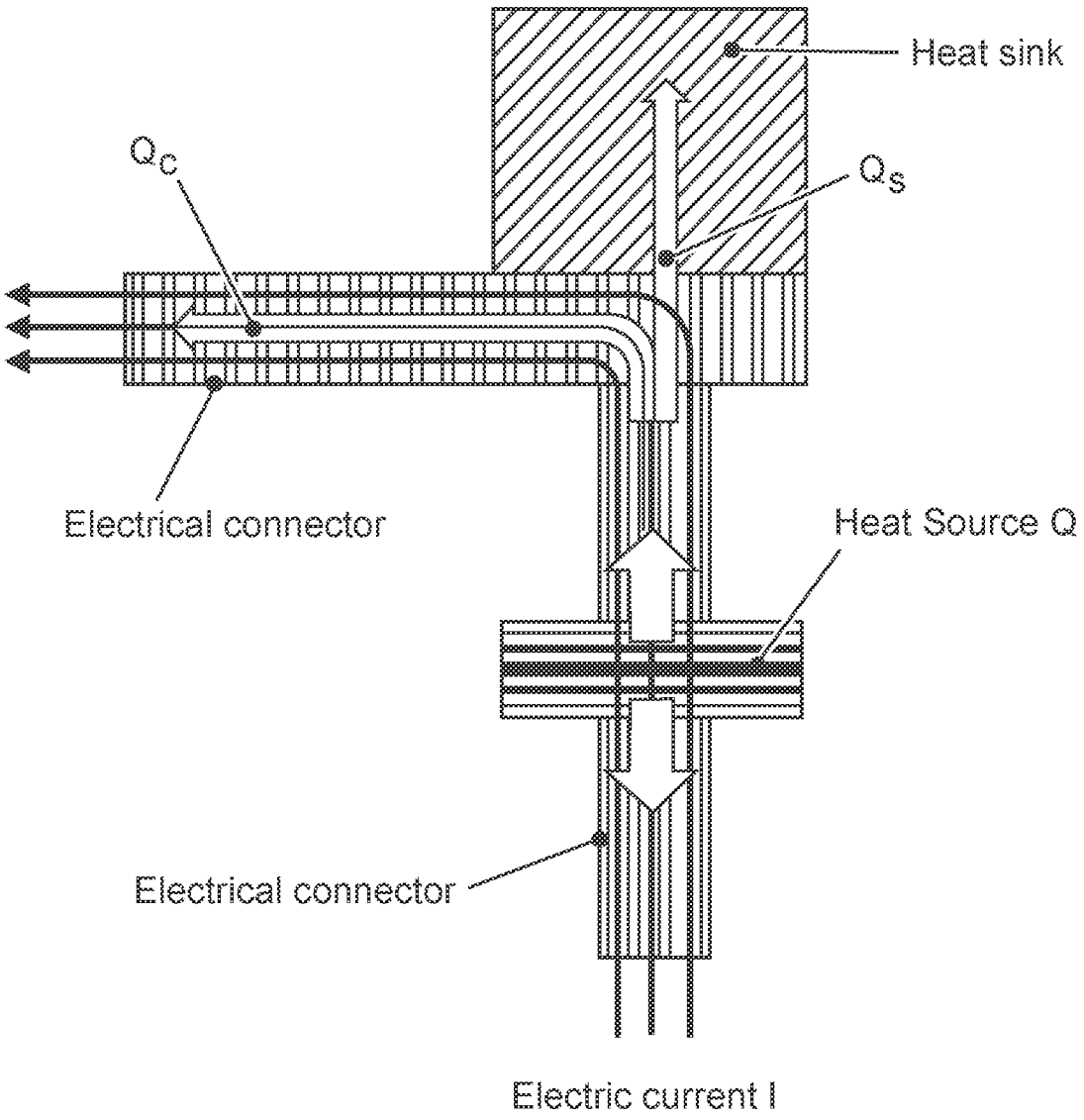
FIG. 4 shows a known cooling arrangement.

Specific details of the new apparatus are further described, where reference is made to FIGS. 1 and 4, in addition to FIGS. 2, 3, and 5 again.

FIG. 1 shows the following parts of a Pole Housing. A hot side 04, which is part of the current path, e.g. a vacuum interrupter and has to be cooled in order to meet the requirements of type test standards. Other parts of the current path 05, e.g. a connection terminal, which block a direct application of any cooling parts physically and are heated up as well during operation. A heatsink 06, which is exposed to the environment and takes up the heat by being attached onto accessible parts, which have to be cooled. In the shown arrangement, it would be better to touch the hot side 04 directly. However, this is not possible in a given Pole Housing.

FIG. 2 shows a part of the new apparatus. This figures shows an arrangement 07 of multiple heat pipes 01, which are grouped and enclosed by a mechanically stable and well heat-conducting cylindrical housing 02. The heat pipes are embedded in a matrix of soldering material 03, which allows a good heat flow towards and away from the heat pipes inside the housing. The complete arrangement, here called a heat pipe-group, behaves like a big heat pipe itself on the one hand but is mechanically stable and easy to handle on the other.

FIG. 3 shows an example of the new apparatus. Here the Heat pipe group can be embedded into the hot side 07 to take up the generated thermal power. This embedding is possible in at least two ways. The first way is to fill up the small gap between the hot side and the Heat pipe group with soldering material itself, so any thermal resistance is minimized by using well-conducting material. The second way of embedding is to drill a borehole into the hot side which is slightly smaller in diameter compared to the outer diameter of the Heat pipe group. In the assembly process, the part of the hot side is heated, so that the borehole increases and the Heat pipe group is cooled to make it contract. In this state it can be inserted and after settling it is connected in a mechanically stable and thermal conducting way.

The Heat pipe group is now exposed to the hot side and can be contacted by a heatsink, which takes over the heat and dissipates it. In this arrangement, the thermal resistance between the hot side and the heatsink is remarkably reduced and the heat flow through other parts 05 mainly avoided.

FIG. 4 shows a representation of an existing cooling apparatus from the front perspective, and also from a side perspective, with a heatsink. FIG. 5 shows a representation of the new apparatus, with the new heat pipe arrangement utilized as discussed above. Now, there is increased heat transport from the interruption unit to the heat sink, and decreased temperatures of both electric conductors connected to the interrupter unit.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An electric pole part apparatus, comprising:
an electric interruption unit;
a heat sink; and
a heat pipe arrangement;
wherein the heat pipe arrangement comprises a plurality of heat pipes enclosed at least partially by an outer housing;
wherein a first end of the heat pipe arrangement is connected to the heat sink;
wherein a second end of the heat pipe arrangement is connected to the electric interruption unit;
wherein the plurality of heat pipes are embedded within a thermal conductive material within the outer housing; and
wherein the thermal conductive material comprises a matrix of soldering material.

2. The electric pole apparatus of claim 1, wherein the second end of the heat pipe arrangement is configured to be inserted into a borehole within the electric interruption unit.

3. The electric pole apparatus of claim 2, wherein a diameter of the outer housing of the heat pipe arrangement at a nominal temperature is greater than an inner diameter of the borehole when the second end is not inserted into the borehole.

4. The electric pole apparatus of claim 3, wherein the second end of the heat pipe arrangement is configured to be inserted into the borehole by heating of at least a part of the electric interruption unit in the vicinity of a borehole.

5. The electric pole apparatus of claim 3, wherein the second end of the heat pipe arrangement is configured to be inserted into the borehole by cooling of the second end of the heat pipe arrangement.

6. The electric pole apparatus of claim 1, wherein a connection of the second end of the heat pipe arrangement to the electric interruption unit comprises a solder connection between the second end of the heat pipe arrangement and the electric interruption unit.

7. The electric pole apparatus of claim 1, wherein the outer housing of the heat pipe arrangement comprises a heat conducting cylindrical housing.

8. The electric pole apparatus of claim 1, further comprising a connection terminal, wherein the connection terminal is located between the electric interruption unit and the heat sink, and wherein the heat pipe arrangement extends through a bore through the connection terminal.

9. The electric pole apparatus of claim 8, wherein an outer surface of the outer housing of the heat pipe arrangement is spaced from an inner surface of the bore through the connection terminal.

10. A method of manufacturing an electric pole part apparatus, the electric pole part apparatus comprising an electric interruption unit, a heat sink, and a heat pipe arrangement, wherein the heat pipe arrangement comprises a plurality of heat pipes enclosed at least partially by an outer housing, and wherein the method comprises:

a) connecting a first end of the heat pipe arrangement to the heat sink;

b) connecting a second end of the heat pipe arrangement to the electric interruption unit and c) embedding the plurality of heat pipes within a thermal conductive material within the outer housing, the thermal conductive material comprising a matrix of soldering material.

11. The method of claim 10, wherein step b) comprises inserting the second end of the heat pipe arrangement into a borehole within the electric interruption unit.

12. The method of claim 11, wherein prior to insertion of the second end of the heat pipe arrangement into the borehole, a diameter of the outer housing of the heat pipe arrangement at a nominal temperature is greater than an inner diameter of the borehole, and wherein step b) comprises heating at least a part of the electric interruption unit in a vicinity of the borehole; and/or wherein step b) comprises cooling the second end of the heat pipe arrangement.

13. The method of claim 10, wherein step b) comprises providing a solder connection between the second end of the heat pipe arrangement and the electric interruption unit.

* * * * *